US011377777B2

(12) United States Patent
Xu et al.

(10) Patent No.: US 11,377,777 B2
(45) Date of Patent: Jul. 5, 2022

(54) WASHING MACHINE

(71) Applicants: QINGDAO HAIER WASHING MACHINE CO., LTD., Shandong (CN); HAIER SMART HOME CO., LTD., Shandong (CN)

(72) Inventors: Sheng Xu, Shandong (CN); Yanfen Lv, Shandong (CN); Xinghui Hao, Shandong (CN); Di Wu, Shandong (CN); Peishi Lv, Shandong (CN)

(73) Assignees: QINGDAO HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 0 days.

(21) Appl. No.: 16/977,971

(22) PCT Filed: Mar. 6, 2019

(86) PCT No.: PCT/CN2019/077127
§ 371 (c)(1),
(2) Date: Sep. 3, 2020

(87) PCT Pub. No.: WO2019/170098
PCT Pub. Date: Sep. 12, 2019

(65) Prior Publication Data

US 2021/0010189 A1 Jan. 14, 2021

(30) Foreign Application Priority Data

Mar. 7, 2018 (CN) ..... 201810187939.1

(51) Int. Cl.
*D06F 39/08* (2006.01)
*D06F 23/04* (2006.01)
*D06F 37/12* (2006.01)

(52) U.S. Cl.
CPC ..... *D06F 39/083* (2013.01); *D06F 23/04* (2013.01); *D06F 37/12* (2013.01)

(58) Field of Classification Search
CPC ..... D06F 39/083; D06F 23/04; D06F 37/12
(Continued)

(56) References Cited

U.S. PATENT DOCUMENTS

2013/0036776 A1* 2/2013 Seo ..... D06F 37/206 68/18 F

FOREIGN PATENT DOCUMENTS

CN 2397150 Y 9/2000
CN 106868774 A 6/2017
(Continued)

OTHER PUBLICATIONS

JP2013141555A—machine translation (Year: 2013).*
(Continued)

*Primary Examiner* — Tinsae B Ayalew
(74) *Attorney, Agent, or Firm* — Buchanan Ingersoll & Rooney PC

(57) ABSTRACT

A washing machine includes a washing barrel, a water collecting device for collecting the discharged water of the washing barrel and a drainage channel. A first drainage outlet is arranged on a lower part of a barrel wall. The drainage channel is arranged on an outer wall of the washing barrel, and communicates with the first drainage outlet, to guide water discharged from the washing barrel to a part below the washing barrel. An upper part of the drainage channel is provided with a water inlet, a lower part is provided with a water outlet. The drainage channel covers the first drainage outlet of the barrel wall in a sealed manner, and the water inlet communicates with the first drainage outlet. The water collecting device comprises a water collecting cavity and a second drainage outlet. The water outlet
(Continued)

of the drainage channel, is arranged within the water collecting cavity.

18 Claims, 8 Drawing Sheets

(58) Field of Classification Search
USPC ..... 68/3 R
See application file for complete search history.

(56) References Cited

FOREIGN PATENT DOCUMENTS

| | | | | |
|---|---|---|---|---|
| CN | 106906610 | A | | 6/2017 |
| CN | 208562861 | U | | 3/2019 |
| JP | 2013141555 | A | * | 7/2013 |

OTHER PUBLICATIONS

International Search Report (PCT/ISA/210), with translation, and Written Opinion (PCT/ISA/237) dated May 20, 2019, by the Chinese Patent Office as the International Searching Authority for International Application No. PCT/CN2019/077127.

* cited by examiner

WASHING MACHINE

TECHNICAL FIELD

The present disclosure belongs to the technical field of washing equipment, and in particular relates to a washing machine.

BACKGROUND ART

A traditional fully automatic wave-wheel washing machine generally includes an inner barrel, an outer barrel, a damping part and a power system. During clothes washing and dehydrating, the inner barrel rotates relative to the outer barrel, such that clothes interact with washing water and the purpose of cleaning clothes or dehydrating is achieved. The outer barrel is installed outside the inner barrel, to provide support for the inner barrel. The outer barrel serves as a water accommodating barrel, and the side wall of the inner barrel is distributed with drainage holes to make the inner barrel communicate with the outer barrel. In the process of washing clothes, clothes are placed in the inner barrel; the water levels of the two barrels are the same. However, the outer barrel is not in contact with clothes, the volume of the outer barrel of the existing washing machine is larger than that of the inner barrel. Therefore, more washing water is stored between the inner barrel and the outer barrel, and detergent between the inner barrel and the outer barrel is not sufficiently utilized, thereby not only increasing the water consumption during clothes washing, but also lowering the concentration of the detergent during washing, and leading to a large volume of the whole washing machine. In addition, after the washing machine is used for a period of time, the inner wall of the outer barrel and the outer wall of the inner barrel will be adhered with dirt, and will even go mouldy, further the washed clothes are polluted, and the barrel wall is difficult to clean.

Aiming at this condition, some manufacturers made improvements. To save water resources, more and more washing machines adopt a holeless inner barrel, such that the inner barrel is separated from the outer barrel, only the inner barrel is configured to store water, while the outer barrel has no water when washing clothes. Drainage holes are formed close to the upper end of the side wall of the inner barrel. In this way, when the washing machine dehydrates, water is thrown onto the inner wall of the inner barrel under the effect of a centrifugal force, and moves upwards along the inner wall of the inner barrel, and is discharged through the drainage hole on the upper end of the inner barrel, thereby improving the water-saving effect of the washing machine, and saving the using amount of detergent.

However, the following problem exists in the above solution: since the washing machine rotates at a high speed during dehydrating, water in clothes is directly thrown out through the drainage holes on the side wall of the inner barrel, directly hits the side wall of the outer barrel, and easily splashes all around, when water exists on the inner wall of the outer barrel for a long time, bacteria easily breed, which is not beneficial for environmental protection.

In addition, to increase the washing capacity of the washing machine, a greater inner barrel is required, that is, the height or diameter of the inner barrel needs to be increased. If the inner barrel has a larger size, then the outer barrel and the casing accommodating the inner barrel also need to be increased along with the increase of the inner barrel.

The increase of the casing of the washing machine will be limited by the space of the region at which the washing machine is placed, and the space for placing the washing machine in the house of users is limited, therefore, it is not realistic to increase the volume of the washing barrel through increasing the casing of the washing machine, then how to increase the capacity of the inner barrel under the premise of not increasing the casing of the washing machine has become a big problem for the designer.

The Chinese patent with the application number of CN99230455.5 discloses a single-barrel type water-saving washing machine. A water collecting device is arranged at the barrel opening of the washing barrel, the water collecting opening of the water collecting device surrounds the barrel opening of the washing barrel along the washing barrel, and the water collecting cavity, arranged on the barrel, of the water collecting device is connected with a number of drainage pipes which are arranged symmetrically from top to bottom along the outer wall of the washing barrel. During drying, the water collecting device collects centrifugal water flow due to high-speed rotation and guides downwards the centrifugal water flow to discharge. Although an outer barrel is omitted in the structure, however, when the washing machine dehydrates, since washing water firstly enters the water collecting device, the water collecting structure is an annular structure; the washing water filled inside the water collecting device is discharged downwards at different speeds, thereby destroying the balance of the washing barrel with high-speed rotation. In addition, after entering the water collecting device, the washing water is guided and converged towards the center below the washing barrel and to discharge, which is not beneficial for water discharge, such that under the effect of a centrifugal force, water concentrated in the water collecting cavity is difficult to discharge, and washing water is concentrated at the upper end of the washing barrel, thereby increasing the weight of the upper part of the washing barrel, and further destroying balance. Especially when much water remains in the washing barrel, most of the washing water is concentrated in the water collecting cavity and is not discharged, thereby making the center of gravity of the washing barrel and the outer barrel higher, generating great vibration noises, also increasing working load of a dehydrating motor, and easily damaging the motor. Finally, the water collecting device is arranged on the upper part of the washing barrel, while the washing barrel rotates during dehydrating, the radial displacement of the upper eccentricity is the maximum, to avoid collision between the water collecting device and the casing of a washing machine, a safe distance between the water collecting device and the casing must be satisfied, and the purpose of capacity expansion cannot be really achieved.

In view of this, the present disclosure is hereby proposed.

SUMMARY

The technical problem to be solved in the present disclosure is to overcome shortcomings of the prior art, and provide a washing machine which can improve dehydrating efficiency and water discharging speed and prevent water splashing and overflow during water discharge.

In order to solve the above technical problem, a basic conception of the technical solution adopted in the present disclosure is as follows. A washing machine is provided. The washing machine includes a box, a washing barrel rotatably arranged in the box, and a drainage channel. A first drainage outlet is arranged on a lower part of a barrel wall of the washing barrel. The drainage channel is arranged on an outer wall of the washing barrel, and is communicated with the first drainage outlet, to guide water discharged from the washing barrel to a part below the washing barrel.

Further, an upper part of the drainage channel is provided with a water inlet, and a lower part of the drainage channel is provided with a water outlet. The drainage channel covers the first drainage outlet arranged on the barrel wall of the washing barrel in a sealed manner, and the water inlet is communicated with the first drainage outlet.

A further solution is as follows: the drainage channel is an independent structure, and includes a housing, a water inlet and a water outlet. The water inlet is arranged on one end of the housing, and the water outlet is arranged on another end of the housing. The water inlet is communicated with the first drainage outlet, and the housing is internally provided with a drainage chamber between the water inlet and the water outlet.

Preferably, the water inlet is arranged on a side wall of a side, adjacent to the outer wall of the washing barrel, of the housing, and cover the first drainage outlet of the washing barrel in a sealed manner.

Further preferably, the water outlet is arranged on a side wall, far away from the outer wall of the washing barrel, of the housing. Or, a water outlet direction of the water outlet is set downwards.

Or, the above alternative solution is as follows: a drainage chamber is formed by the drainage channel and the outer wall of the washing barrel. The drainage channel includes a cover body which is arranged on the outer wall of the washing barrel and cooperates with the outer wall of the washing barrel to form the drainage chamber which discharges water downwards. The first drainage outlet constitutes a water inlet of the drainage chamber, and a lower part of the drainage chamber is provided with a water outlet.

Further, the water outlet is formed on the cover body, or, a downward opening which is formed between the cover body and the outer wall of the washing barrel constitutes the water outlet.

Further, at least one first drainage outlet is provided, at least one drainage channel is provided, and each drainage channel is corresponding to at least one first drainage outlet.

Preferably, at least two first drainage outlets are provided and are arranged at intervals along a circumferential direction of the washing barrel, and at least two drainage channels are provided and are arranged at intervals along the circumferential direction of the washing barrel.

Further, the washing machine also includes a water collecting device which is arranged inside the box and configured to collect water discharged from the washing barrel. The water collecting device includes a water collecting cavity and at least one second drainage outlet. The water outlet, which discharges water downwards, of the drainage channel, is arranged within the water collecting cavity.

Preferably, an upper edge of a barrel wall constituting the water collecting cavity is higher than the water outlet.

More preferably, the upper edge of the barrel wall of the water collecting cavity is not higher than the first drainage outlet.

Further, the water collecting cavity is internally provided with an annular groove. The annular groove extends downwards and is lower than the bottom wall of the water collecting cavity, and the water outlet of the drainage channel is arranged within the annular groove.

Further, a depth of the annular groove is set variably from high to low along a circumferential direction, and at least one second drainage outlet is arranged on a lowest part of the annular groove.

Preferably, the depth of the annular groove is set variably from high to low along a direction which is the same as a rotating direction of the washing barrel during dehydrating.

Further, a part, higher than the first drainage outlet, of the barrel wall of the washing barrel is an impermeable structure, and an inside of the washing barrel is communicated with an outside via the first drainage outlet on the lower part of the barrel wall.

Further, an inner wall of the washing barrel is further provided with a water guiding channel which guides water to discharge from top to bottom. A lower part of the water guiding channel covers the first drainage outlet, an upper part of the water guiding channel is provided with a water inlet. The water guiding channel is provided with a water guiding chamber which is communicated with the water inlet and the first drainage outlet, and the water guiding chamber is communicated with the inside of the washing barrel via the water inlet.

Further, the water guiding channel, the first drainage outlet and the drainage channel are communicated in sequence to constitute a channel through which water is discharged towards an outside from the inside of the washing barrel during dehydrating.

Further, at least one first drainage outlet is provided, at least one water guiding channel is provided, and the lower part of each the water guiding channel covers at least one first drainage outlet correspondingly.

Preferably, at least two first drainage outlets are provided and are arranged at intervals along the circumferential direction of the washing barrel, and at least two water guiding channels are provided and are arranged at intervals along the circumferential direction of the washing barrel.

Further, the water guiding channel is an independent structure. A water guiding chamber is arranged in the water guiding channel. Or, a water guiding chamber is formed by the water guiding channel and the inner wall of the washing barrel.

Further, the water inlet is arranged on a radial side wall of the water guiding channel. Preferably, the water inlet is arranged on the radial side wall, facing a rotating direction of the washing barrel during dehydrating, of the water guiding channel. An opening of the water inlet faces of the washing barrel during dehydrating.

Further, a balanced ring is provided above the washing barrel. A gap is formed between a radial side wall, facing a rotating direction of the washing barrel during dehydrating, of the water guiding channel and the balanced ring, the gap constitutes the water inlet. Another radial side wall, opposite to the radial side wall, of the washing barrel during dehydrating extends to a lower surface of the balanced ring. Preferably, the another radial side wall is arranged in a sealed manner with the lower surface of the balanced ring.

After the above technical solution is adopted, the present disclosure has the following beneficial effects compared with the prior art.

The washing barrel of the washing machine in the present disclosure can be configured to accommodate water in the washing process; therefore, the washing barrel adopts a "holeless inner barrel" structure. Meanwhile, an outer barrel is not provided, and the water collecting device is adopted to replace the outer barrel to collect water and discharge water, such that the present disclosure has the following technical effects.

1. When the volume of the box of the washing machine is unchanged, the capacity of the washing barrel can be increased, and the effect of capacity expansion of the washing machine can be realized.

2. In the washing process, water only exists in the washing barrel, thereby avoiding the problem of dirt accumulation in the inner wall of the outer barrel and the outer wall of the washing barrel caused by water stored between the inner barrel and the outer barrel of a traditional washing machine, and having a better washing effect.

3. An outer barrel is not provided, the washing barrel is taken as a water accommodating barrel, no water is stored between the inner barrel and the outer barrel in the washing process, thereby reducing water consumption during washing, and saving water used during washing.

4. When water is discharged through the first drainage outlet on the lower part of the barrel wall of the washing barrel by utilizing the water guiding channel from top to bottom inside the washing barrel, a situation that occupying the space between the washing barrel and the box by the water guiding structure installed on the upper part of the outer wall of the washing barrel in the prior art can be avoided, and a real capacity expansion effect can be achieved.

5. The water inlet of the water guiding channel is arranged on the radial side wall, facing a rotating direction of the washing barrel during dehydrating, of the water guiding channel. Another radial side wall, opposite to the radial side wall, of the washing barrel during dehydrating is arranged in a sealed manner. Washing water more easily enters the water guiding channel along the circumferential direction of the washing barrel, thereby improving water discharging speed.

6. The drainage channel is installed on the lower part of the outer wall of the washing barrel, water discharged through the first drainage outlet is guided downwards, thereby not only avoiding upward extension of the water collecting device, and realizing the effect of capacity expansion, but also guiding water to the water collecting cavity of the water collecting device, improving water discharging speed, and obtaining the effect of preventing water splashing.

7. The bottom wall of the water collecting cavity of the water collecting device is provided with the annular groove structure to guide water to flow to the drainage outlet, thereby better guiding water and discharging water, and better realizing water collection and water discharge and preventing water accumulation and water overflow while ensuring water discharge and water splashing of the drainage channel.

A further detailed description will be proposed below on specific embodiments of the present disclosure in combination with accompanying drawings.

BRIEF DESCRIPTION OF THE DRAWINGS

As a part of the present disclosure, accompanying drawings are used for providing a further understanding of the present disclosure, schematic embodiments and descriptions thereof of the present disclosure are used for explaining the present disclosure, rather than constituting an improper limit to the present disclosure. Obviously, accompanying drawings described below are merely some embodiments, for those skilled in the art, other drawings can be obtained based on these drawings without any creative effort. In the drawings.

Figure 1:
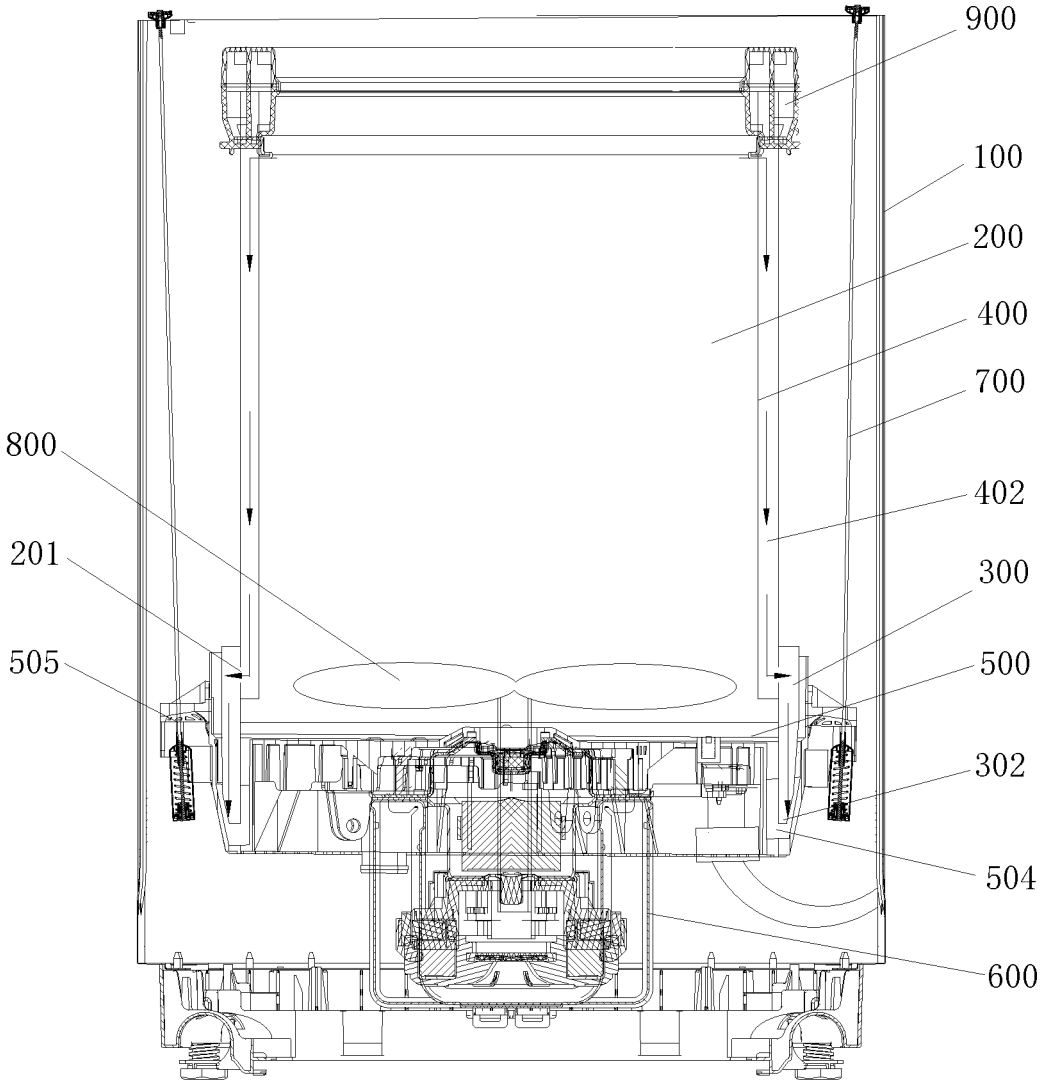
FIG. 1 is a structural schematic diagram of the washing machine of the present disclosure.

It should be noted that, these drawings and text descriptions are not aiming at limiting a conception range of the present disclosure in any form, but to describe concepts of the present disclosure for those skilled in the art with a reference to specific embodiments.

DETAILED DESCRIPTION OF THE EMBODIMENTS

In order to make the object, technical solutions and advantages of the embodiments in the present disclosure clearer, a clear and complete description will be proposed below on technical solutions in the embodiments in combination with accompanying drawings in the embodiments of the present disclosure. The following embodiments are used for describing the present disclosure, rather than for limiting the scope of the present disclosure.

In the description of the present disclosure, it should be noted that, the orientation or positional relationship indicated by such terms as "up", "down", "front", "rear", "left", "right", "vertical", "inner" and "outer" is the orientation or positional relationship based on the accompanying drawings. Such terms are merely for the convenience of description of the present disclosure and simplified description, rather than indicating or implying that the device or element referred to must be located in a certain orientation or must be constructed or operated in a certain orientation, therefore, the terms cannot be understood as a limitation to the present disclosure.

Embodiment 1

As shown in FIG. 1 to FIG. 4, a washing machine of the present embodiment includes a box 100, a washing barrel 200 rotatably arranged in the box, and a drainage channel 300. A first drainage outlet 201 is arranged on a lower part of a barrel wall of the washing barrel 200. The drainage channel 300 is arranged on an outer wall of the washing barrel 200, and is communicated with the first drainage outlet 201, to guide water discharged from the washing barrel 200 to flow to an area below the washing barrel.

An upper part of the drainage channel 300 in the present embodiment is provided with a water inlet 301, a lower part of the drainage channel 300 is provided with a water outlet 302. The drainage channel 300 covers the first drainage outlet 201 on the barrel wall of the washing barrel in a sealed manner, and the water inlet 301 is communicated with the first drainage outlet 201.

Preferably, at least one first drainage outlet 201 is provided, at least one drainage channel 300 is provided, and each drainage channel 300 corresponds to at least one first drainage outlet 201.

Further, at least two first drainage outlets 201 are provided and are arranged at intervals along the circumferential direction of the washing barrel 200, and at least two drainage channels 300 are provided and are arranged at intervals along the circumferential direction of the washing barrel 200.

Embodiment 2

Figure 3:
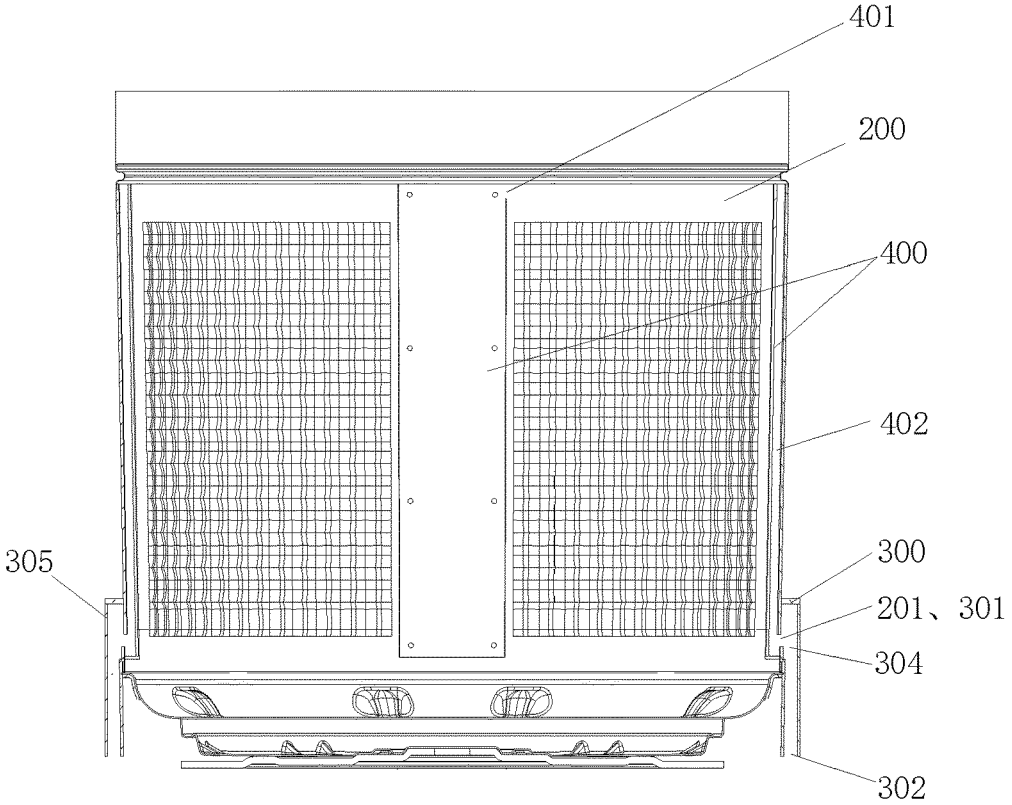
FIG. 3 is a schematic diagram of another embodiment of the washing barrel of the washing machine of the present disclosure.
Figure 4:
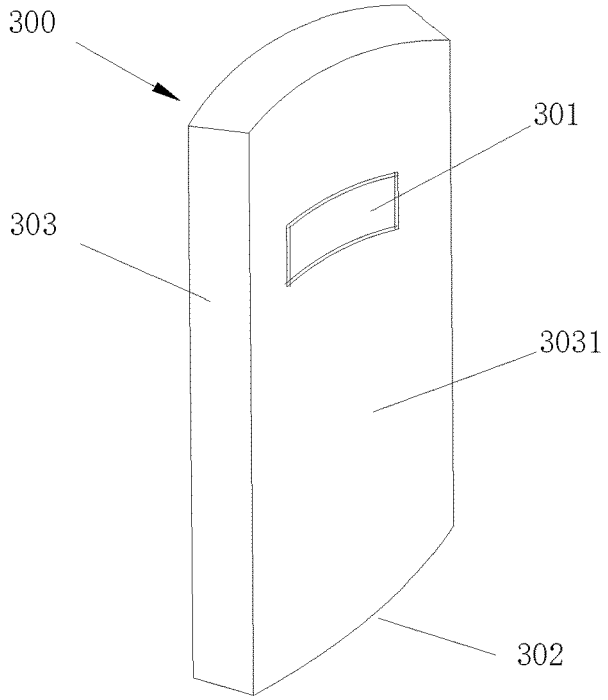
FIG. 4 is a structural schematic diagram of an embodiment of the drainage channel of the present disclosure.

As shown in FIG. 4, the drainage channel 300 of the present embodiment is an independent structure. The drainage channel 300 includes a housing 303, a water inlet 301 and a water outlet 302. The water inlet 301 is arranged at one end of the housing 303 and the water outlet 302 is arranged at another end of the housing. The water inlet 301 is communicated with the first drainage outlet 201, and the housing 303 is internally provided with a drainage chamber 304 between the water inlet 301 and the water outlet 302 (please refer to FIGS. 2 and 3).

Preferably, the water inlet 301 is formed on a side wall 3031, adjacent to the outer wall of the washing barrel 200, of the housing 303 and connected with the first drainage outlet 201 of the washing barrel in a sealed manner.

Further preferably, the water outlet is arranged on a side wall, far away from the peripheral wall of the washing barrel, of the housing, (not shown in the figure). Or, a water outlet direction of the water outlet 302 is set downwards (please refer to FIGS. 2 and 3).

Embodiment 3

Figure 2:
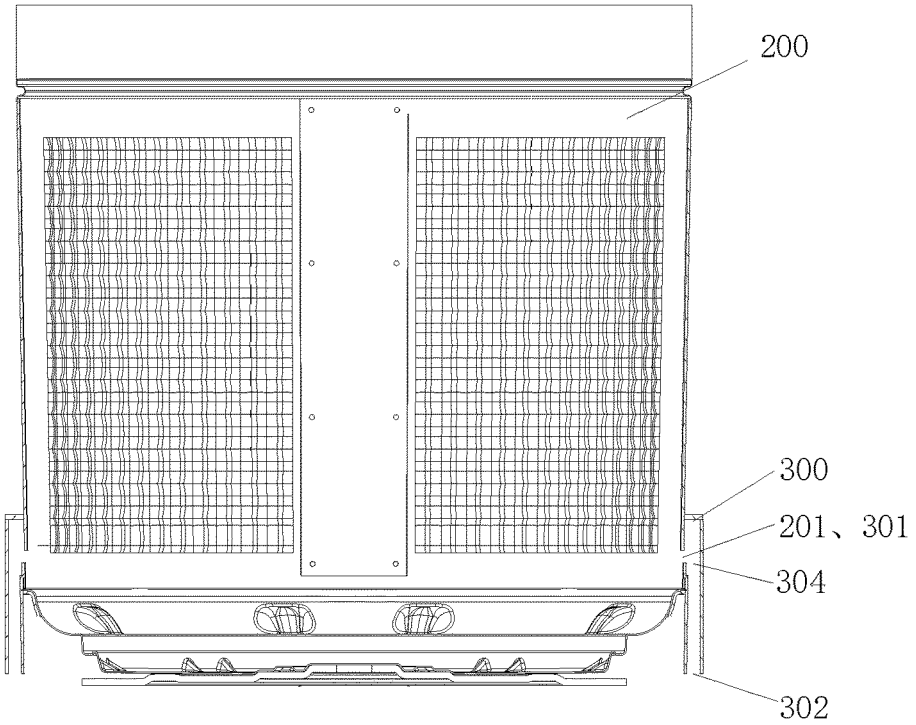
FIG. 2 is a schematic diagram of an embodiment of the washing barrel of the washing machine of the present disclosure.

The present embodiment differs from the above embodiment as follows: as shown in FIG. 2 and FIG. 3, the drainage channel 300 and the outer wall of the washing barrel 200 cooperate to form a drainage chamber 304. The drainage channel 300 includes a cover body 305 which is arranged on the outer wall of the washing barrel 200 and cooperates with the outer wall of the washing barrel 200 to form the drainage chamber 304 which discharges water downwards. The first drainage outlet 201 constitutes the water inlet 301 of the drainage chamber, and a lower part of the drainage chamber 304 is formed with a water outlet 302.

Further, the water outlet is formed on the cover body. Or, a downward opening which is formed between the cover body and the outer wall of the washing barrel constitutes the water outlet (not shown in the figure).

Embodiment 4

Figure 5:
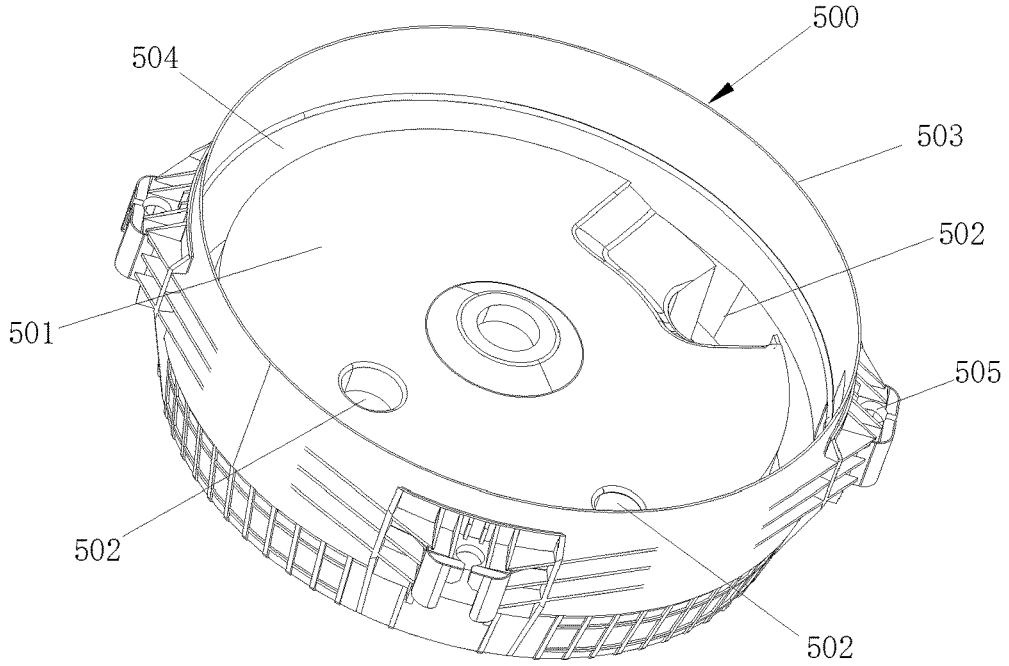
FIG. 5 is a structural schematic diagram of an embodiment of the water collecting device of the present disclosure.
Figure 6:
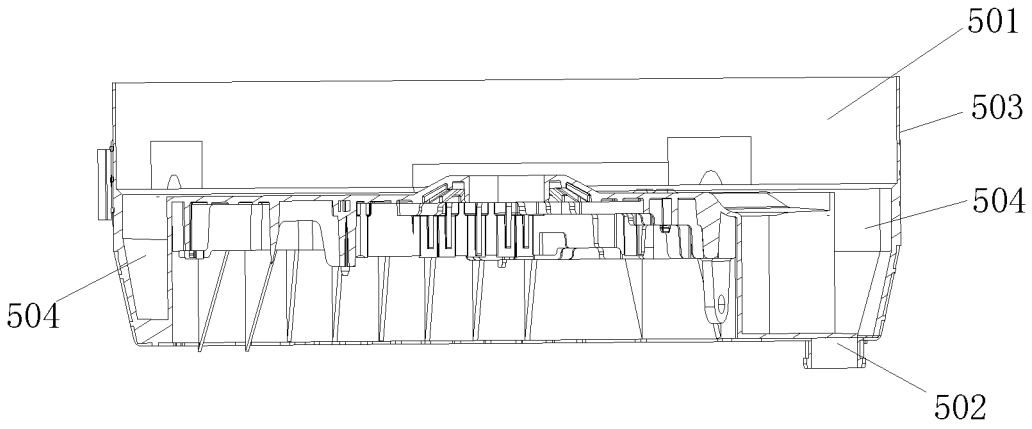
FIG. 6 is a sectional view of an embodiment of the water collecting device of the present disclosure.

As shown in FIG. 1 and FIG. 5, the washing machine of the present embodiment includes a washing barrel 200 configured to accommodate water in the washing process and a water collecting device 500 configured to collect water discharged from the washing barrel 200. The water collecting device 500 includes a water collecting cavity 501 and a second drainage outlet 502 communicated with the water collecting cavity 501. The water outlet 302, which discharges water downwards, of the drainage channel 300, is arranged within the water collecting cavity 501.

Preferably, an upper edge of a side wall 503 of the water collecting cavity is higher than the water outlet 302 of the drainage channel 300.

More preferably, the upper edge of the side wall 503 of the water collecting cavity is not higher than the first drainage outlet 201.

A part, higher than the first drainage outlet 201, of the barrel wall of the washing barrel in the present embodiment is an impermeable structure. An inside of the washing barrel 200 is communicated with an outside via the first drainage outlet 201 on the lower part of the barrel wall. That is, the other region, except the first drainage outlet 201, of the barrel wall of the washing barrel is a sealed structure.

The washing barrel 200 serves as a water accommodating barrel of the washing machine, no other outer barrel is arranged outside the washing barrel 200, and only the water collecting device 500 is arranged below the washing barrel 200. In this way, the washing water of the washing barrel is firstly discharged to the water collecting device 500 and then discharged through the second drainage outlet 502. Therefore, the water collecting cavity 501 of the water collecting device 500 has functions of receiving water and collecting water. A height of the water collecting device 500 is smaller than a height of the washing barrel 200, and the bottom of the washing barrel 200 is arranged in the water collecting cavity 501, and at least an upper part of the washing barrel extends outside an upper opening of the water collecting cavity 501.

Embodiment 5

The washing barrel 200 of the washing machine in the present embodiment is a "holeless inner barrel". In the washing process, the washing barrel 200 is just taken as a water accommodating barrel. A lower part of a barrel wall of the washing barrel 200 is provided with a first drainage outlet 201, to realize the function of dehydrating. Meanwhile, a drainage channel is arranged on the barrel wall of the washing barrel 200, thereby guiding water in the dehydrating process of the washing machine into the water collecting cavity 501 of the water collecting device 500 through a drainage channel to collect and discharge, and preventing dehydrated water flow from splashing into the box of the washing machine.

In the present embodiment, a bottom wall of the water collecting cavity 501 is provided with a water guiding structure for guiding water to flow to the second drainage outlet 502, to ensure timely discharge of the water flow, and prevent overflow due to excessive and fast water accumulation in the water collecting device 500. Whole or part of the bottom wall of the water collecting cavity 501 is set transitionally from high to low to form the water guiding structure, and the second drainage outlet 502 is arranged at a position, below a highest water level, of the bottom wall of the water collecting cavity 501. In this way, discharged water can be better discharged to the second drainage outlet 502 to discharge along the water guiding structure of the water collecting cavity 501.

Embodiment 6

The bottom wall of the water collecting cavity 501 of the present embodiment is set with an annular groove 504 concaved from the bottom wall of the water collecting cavity. A bottom of the annular groove 504 extends downwards and is lower than the bottom wall of the water collecting cavity 501. A depth of the annular groove 504 in a vertical direction is set transitionally from high to low to form the water guiding structure. The second drainage outlet 502 is arranged in the annular groove 504 and is arranged at a lowest position. The water outlet 302 of the drainage channel 300 is arranged within the annular groove. In the present embodiment, the annular groove 504 is arranged within the water collecting cavity 501, on the one hand, the volume of collected water can be enlarged, and on the other hand, water can be prevented from splashing. The water level of the annular groove in the water collecting cavity 501 is the lowest; therefore, the setting of the second drainage outlet 502 in the annular groove is more beneficial for water discharge.

Specifically, the annular groove 504 of the present embodiment is arranged circumferentially along the bottom wall of the water collecting cavity 501. The depth of the annular groove 504 in the vertical direction is set transitionally from high to low at the clockwise or anticlockwise direction, to form the water guiding structure.

Preferably, the depth of the annular groove 504 is set variably from high to low along a direction which is the same as the rotating direction of the washing barrel 200 during dehydrating.

As a preferable embodiment of the present embodiment, the bottom of the annular groove 504 is of a spiral structure or a step-shaped structure from high to low and the second drainage outlet 502 is arranged in the annular groove and is arranged at the position with the lowest water level of the spiral structure or the step-shaped structure. In this way, water can be discharged completely, thereby avoiding storage of water in the water collecting cavity 501.

Embodiment 7

The water collecting device 500 of the present embodiment is arranged below the washing barrel 200 and is set to be coaxial with the washing barrel. The drainage channel 300 includes a part of the structures which extend to the annular groove 504 of the water collecting device 500 from top to bottom. The depth of the annular groove 504 along the vertical direction is increased along the rotating direction of the washing barrel during dehydrating. In the present embodiment, the drainage channel 300 extends to the annular groove 504 of the water collecting device 500, to collect water in the dehydrating process in the annular groove 504 and discharge. Meanwhile, the depth of the annular groove 504 is larger than that of the water collecting cavity 501, thereby preventing water splashing during dehydrating.

The water collecting device 500 of the present embodiment is a basin structure which is internally provided with a cavity. The water collecting device 500 is installed in the box 100 of the washing machine in a hanging manner via a hanging rod 700. A peripheral wall of the water collecting device 500 is provided with a hanging rod installation base 505 for assembling the hanging rod 700. Preferably, four hanging rod installation bases are arranged and are distributed uniformly along a circumferential direction.

The bottom wall of the water collecting device 500 of the present embodiment is installed with a driving device 600, and the driving device comprises a washing barrel shaft and a wave wheel shaft which drive the washing barrel 200 and the wave wheel 800 to rotate respectively.

Embodiment 8

As shown in FIG. 1 and FIG. 3, an inner wall of the washing barrel 200 of the present disclosure is further provided with a water guiding channel 400 which guides water outwards from top to bottom. A lower part of the water guiding channel 400 covers the first drainage outlet 201, an upper part of the water guiding channel 400 is provided with a water inlet 401. The water guiding channel 400 is provided with a water guiding chamber 402 communicated with the water inlet 401 and the first drainage outlet 201. And the water guiding chamber 402 is communicated with the inside of the washing barrel 200 via the water inlet 401.

Further, the water guiding channel 400, the first drainage outlet 201 and the drainage channel 300 are communicated in sequence to constitute a channel through which water is discharged towards an outside from the inside of the washing barrel 200 during dehydrating.

In the present embodiment, at least one first drainage outlet 201 is provided, at least one water guiding channel 400 is provided, and a lower part of each the water guiding channel 400 covers at least one first drainage outlet 201 correspondingly.

Preferably, at least two first drainage outlets 201 are provided and are arranged at intervals along the circumferential direction of the washing barrel 200, and at least two water guiding channels 400 are provided and are arranged at intervals along the circumferential direction of the washing barrel 200.

Further, the water guiding channel 400 is an independent structure. The water guiding channel 400 is internally provided with a water guiding chamber. Or, the water guiding channel 400 and the inner wall of the washing barrel 200 cooperate to form a water guiding chamber (please refer to FIGS. 7 and 8). For the installation structures of the water guiding channel and the washing barrel, please refer to the design of the drainage channel and the washing barrel.

Figure 7:
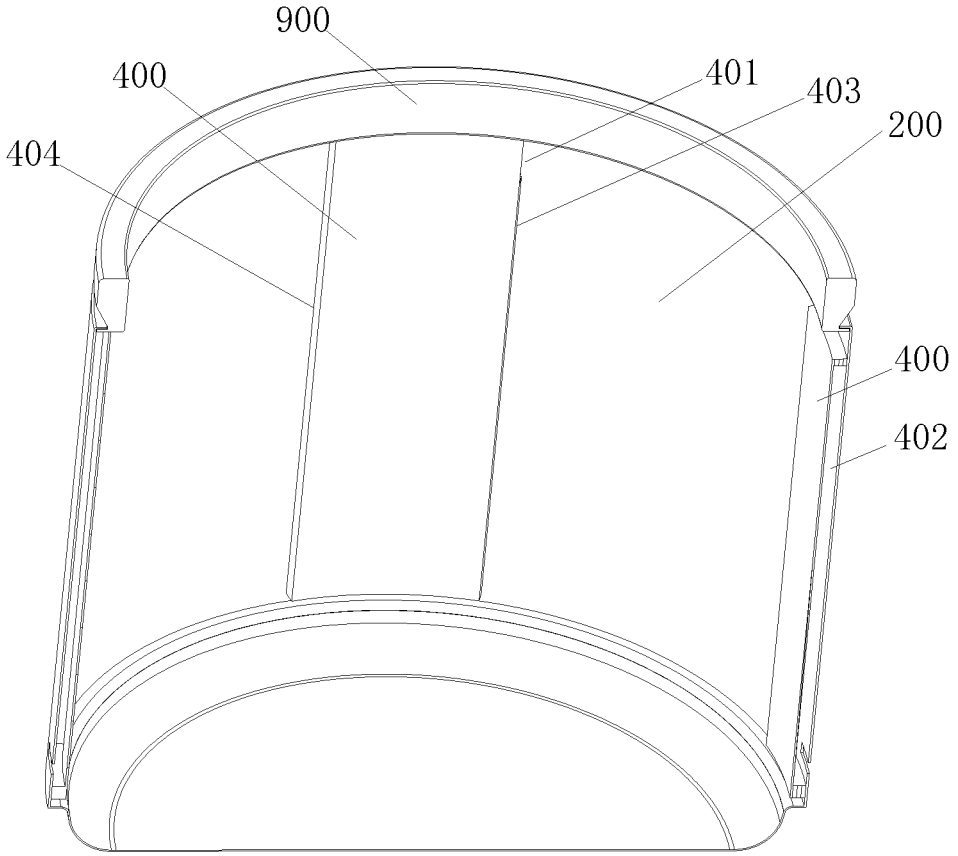
FIG. 7 is a schematic diagram of an embodiment in which the water guiding channel is installed on the washing barrel of the present disclosure.
Figure 8:
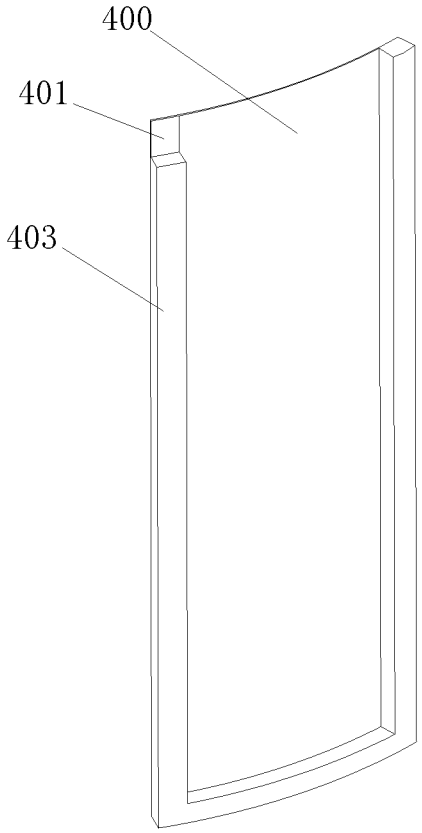
FIG. 8 is a structural schematic diagram of an embodiment of the water guiding channel of the present disclosure.

As shown in FIG. 7 and FIG. 8, the water inlet 401 is arranged on a radial side wall 403 of the water guiding channel 400. Preferably, the water inlet 401 is arranged on the radial side wall, facing a rotating direction of the washing barrel 200 during dehydrating, of the water guiding channel, and an opening of the water inlet 401 faces the rotating direction of the washing barrel 200 during dehydrating.

Preferably, a balanced ring 900 is provided above an opening of the washing barrel 200 of the present embodiment. A gap is formed between a radial side wall 403, facing a rotating direction of the washing barrel during dehydrating, of the water guiding channel 400 and the balanced ring 900. The gap constitutes the water inlet 401 (please refer to FIG. 7). Another radial side wall, opposite to the radial side wall, of the washing barrel 200 during dehydrating extends to a lower surface of the balanced ring 900. Preferably, the another radial side wall is arranged in a sealed manner with the lower surface of the balanced ring 900.

Embodiment 9

As shown in FIG. 1, FIG. 9 to FIG. 15, the washing barrel 200 of the washing machine of the present embodiment is taken as a water accommodating barrel; no other outer barrel is arranged outside the washing barrel 200. Only the water collecting device 500 is arranged below the washing barrel 200 in the present embodiment. In this way, the washing water of the washing barrel is discharged to the water collecting device 500 and then discharged, therefore, the water collecting device 500 is provided with the water collecting cavity 501 to realize a function of temporarily storing water. Although the washing machine of the present embodiment no longer has an outer barrel, the bottom of the washing barrel 200 is still arranged in the water collecting cavity of the water collecting device 500. Therefore, a certain distance should be kept between the washing barrel 200 and the water collecting cavity of the water collecting device, to prevent collision between the washing barrel and the water collecting device during dehydrating. In the present embodiment, a reinforced structure for enhancing strength of the water collecting cavity 501 is provided on the side wall 503 of the water collecting cavity 501, thereby increasing the overall strength of the water collecting device, preventing such phenomena as barrel collision and barrel abrasion generated by a decreased space between the washing barrel and the water collecting device caused by deformation of the water collecting device, and ensuring stability of the washing and dehydrating conditions of the washing barrel.

Figure 9:
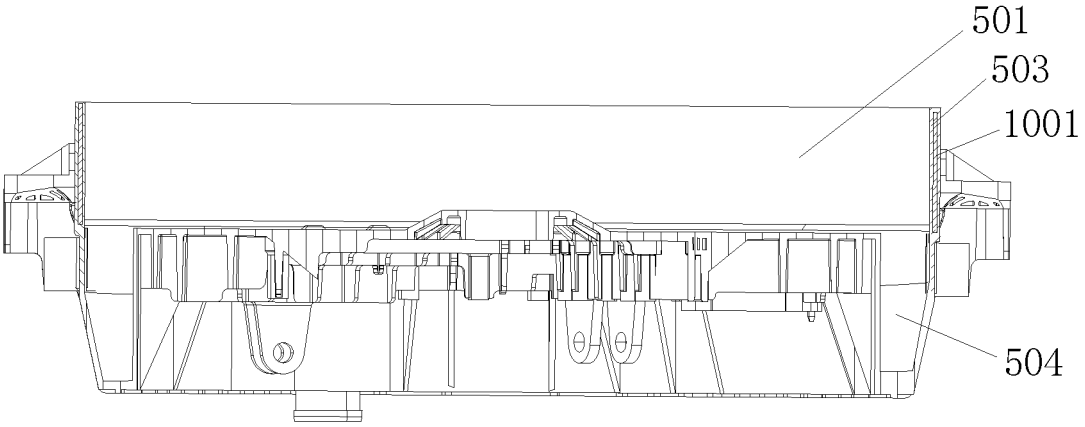
FIG. 9 is a sectional view of an embodiment of the water collecting device of the washing machine of the present disclosure.
Figure 11:
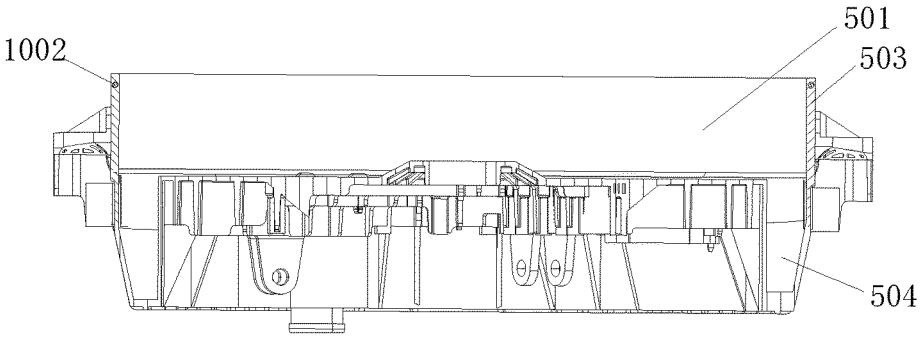
FIG. 11 is a sectional view of another embodiment of the water collecting device of the washing machine of the present disclosure.

As shown in FIG. 9 and FIG. 11, the reinforced structure of the present embodiment is a reinforced piece which is embedded and injection molded within a side wall of the water collecting cavity. In the present embodiment, when the reinforced piece is injection molded within the side wall of the water collecting cavity, the purpose of enhancing the strength of the side wall of the water collecting cavity is realized.

Figure 10:
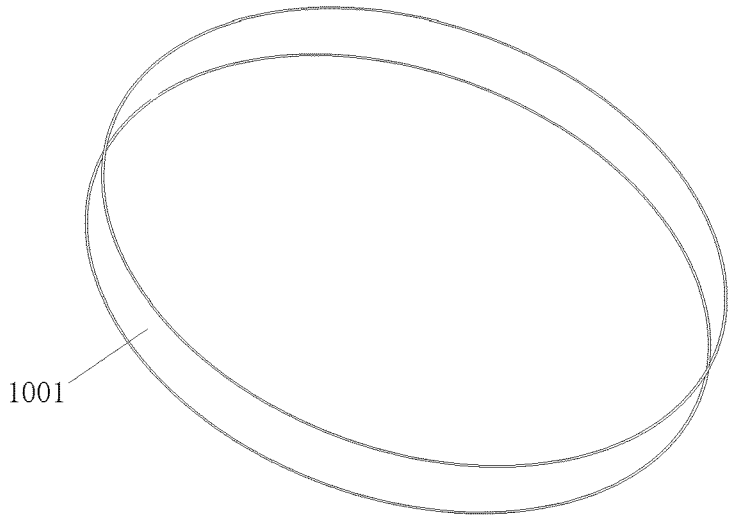
FIG. 10 is a three-dimensional structural schematic diagram of an embodiment of a reinforced structure of the present disclosure.

As shown in FIG. 9 and FIG. 10, as an implementing manner of the present embodiment, the reinforced piece is a flaky reinforced ring 1001 matched with the side wall of the water collecting cavity 501. The flaky reinforced ring 1001 is vertically embedded and injection molded within the side wall of the water collecting cavity 501. In this way, the side wall of the water collecting cavity 501 is subject to an enhanced effect of the embedded flaky reinforced ring 1001 in the whole vertical direction, and the overall strength is higher.

Figure 12:
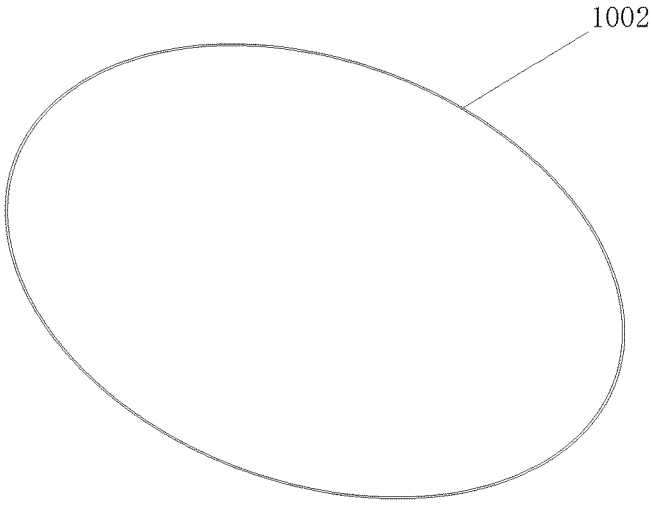
FIG. 12 is a three-dimensional structural schematic diagram of another embodiment of the reinforced structure of the present disclosure.

Or, as shown in FIG. 11 and FIG. 12, the reinforced piece is a steel wire reinforced ring 1002 matched with the side wall of the water collecting cavity 501. The water collecting device includes an opening of the water collecting cavity, and the steel wire reinforced ring 1002 is embedded and injection molded inside the side wall of the water collecting cavity 501 and is set to be close to the opening of the water collecting cavity. The steel wire reinforced ring 1002 is arranged along the side wall of the water collecting cavity 501 on the whole circumferential direction, to enhance the strength on the whole circumferential direction. By the steel wire reinforced ring 1002 being set to be close to the opening of the water collecting cavity, the opening of the water collecting cavity has such strength that the opening is not easily deformed.

Figure 13:
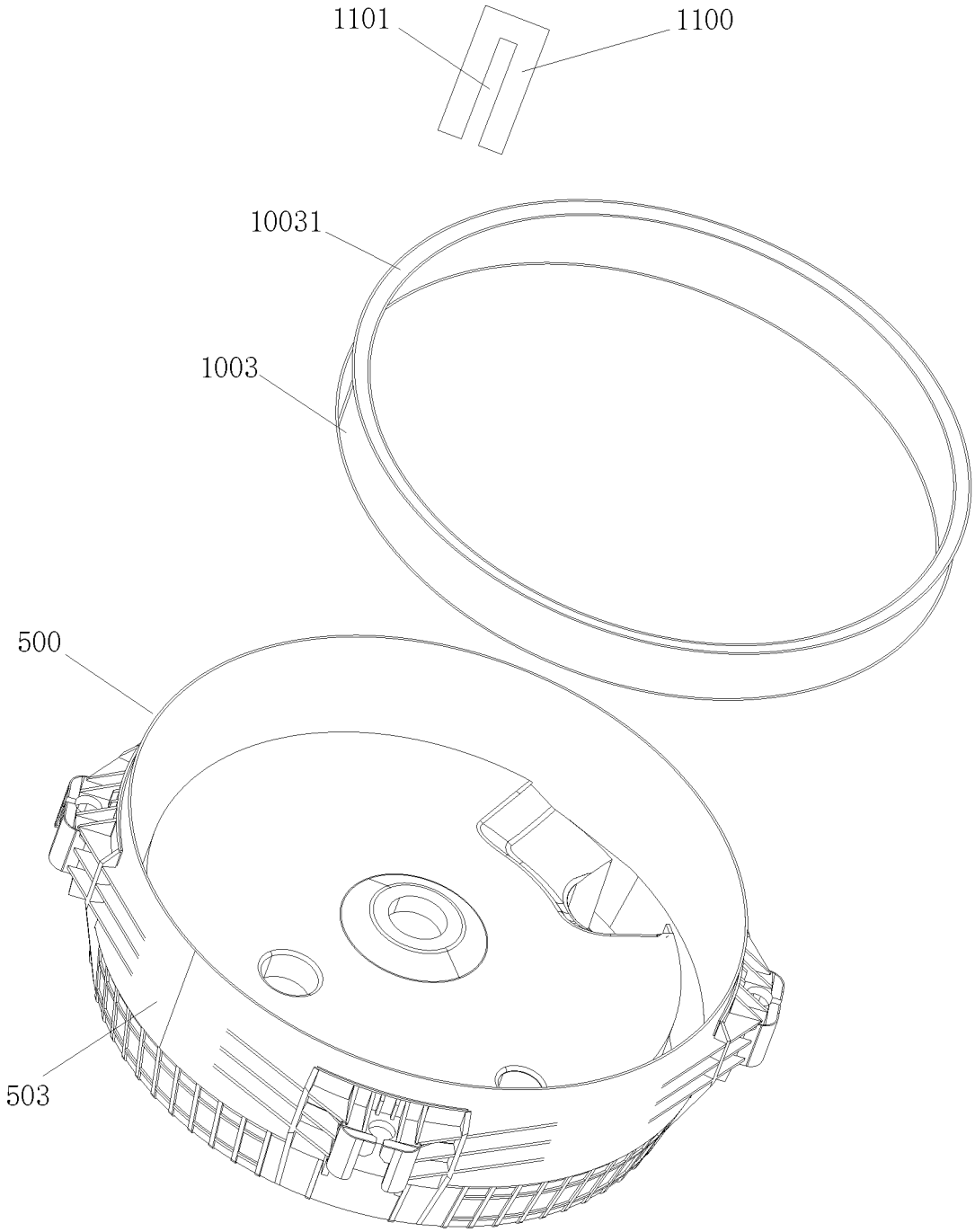
FIG. 13 is an exploded view of still another embodiment of the water collecting device of the washing machine of the present disclosure.
Figure 14:
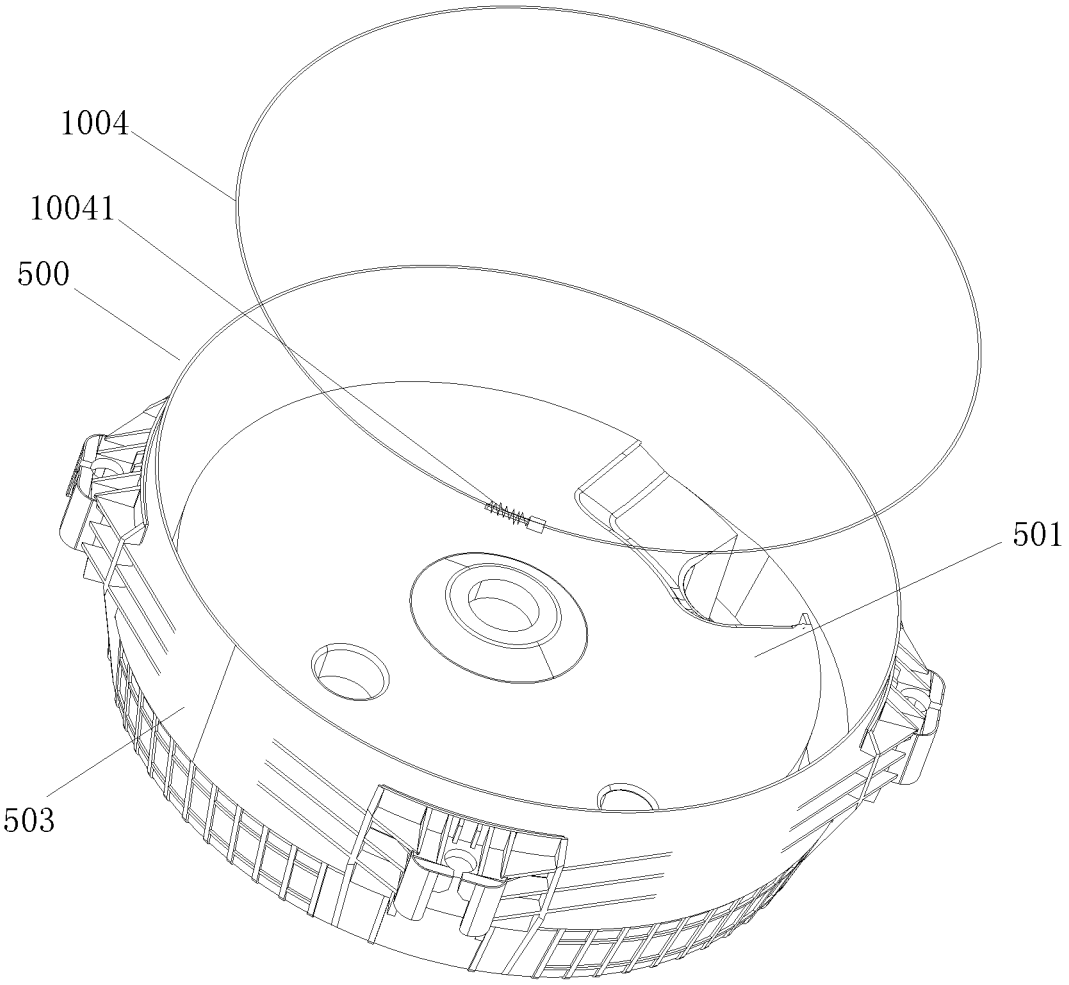
FIG. 14 is an exploded view of still another embodiment of the water collecting device of the washing machine of the present disclosure.

As shown in FIG. 13 and FIG. 14, as an implementing manner of the present embodiment, the reinforced structure is a reinforced piece which is fastened on an inner side of the side wall of the water collecting cavity. An outer diameter of the reinforced piece is slightly smaller than an inner diameter of the side wall of the water collecting cavity.

Or, the reinforced structure is a reinforced piece fastened on an outer side of the side wall of the water collecting cavity. An inner diameter of the reinforced piece is slightly larger than an outer diameter of the side wall of the water collecting cavity.

As shown in FIG. 13, the reinforced piece is a flaky reinforced ring 1003 matched with the side wall of the water collecting cavity. The flaky reinforced ring 1003 is fastened on the inner side or the outer side of the side wall 503 of the water collecting cavity 501 via a holding device 1100.

The holding device 1100 of the present embedment includes a clamping groove 1101, and the flaky reinforced ring 1003 is fastened on the inner side or the outer side of the side wall 503 of the water collecting cavity 501 via the clamping groove.

Further, an opening on an upper end of the flaky reinforced ring 1003 of the present embodiment is provided with a flanging structure 10031, to further enhance the overall strength of the flaky reinforced ring 1003.

Or, as shown in FIG. 14, the reinforced piece is a steel wire reinforced ring 1004 matched with the side wall of the water collecting cavity, the steel wire reinforcing ring 1004 is connected via a clamp nut 10041 and is a closed ring. The water collecting device 500 includes an opening of the water collecting cavity, and the steel wire reinforced ring 1004 is fastened on the inner side or the outer side of the side wall 503 of the water collecting cavity 501 by adjusting the clamp nut 10041 and is arranged close to the opening of the water collecting cavity 501.

Figure 15:
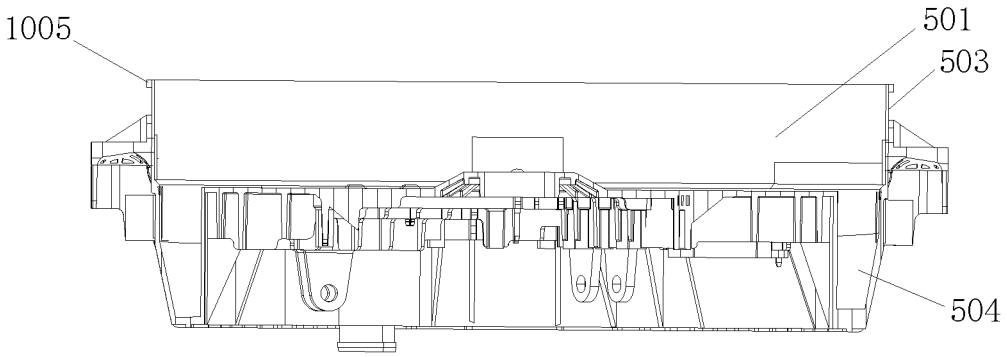
FIG. 15 is a sectional view of still another embodiment of the water collecting device of the washing machine of the present disclosure.

Still or, as shown in FIG. 15, the water collecting device 500 includes an opening of the water collecting cavity, and the reinforced structure is a flanging structure 1005 which is formed by flanging an edge of the opening of the water collecting cavity outwards or inwards.

What is described above is merely the preferred embodiments of the present disclosure, rather than limiting the present disclosure in any form, although the present disclosure has been disclosed above with the preferred embodiments, the preferred embodiments are not used for limiting the present disclosure, those skilled in the art can make some changes or modify into equivalent embodiments with equal changes by utilizing the above suggested technical contents without departing from the scope of the technical solution of the present disclosure, and the contents not departing from the technical solution of the present disclosure, any simple amendments, equivalent changes or modifications made to the above embodiments based on the technical essence of the present disclosure shall all fall within the scope of the solution of the present disclosure.

The invention claimed is:

1. A washing machine, comprising:

a box;

a washing barrel, being rotatably arranged in the box;

a drainage channel, being arranged on an outer wall of the washing barrel;

wherein a first drainage outlet is arranged on a lower part of a barrel wall of the washing barrel, and the drainage channel communicates with the first drainage outlet, to guide water discharged from the washing barrel to a part below the washing barrel;

an inner wall of the washing barrel is provided with a water guiding channel which guides water to discharge from top to bottom, a lower part of the water guiding channel covers the first drainage outlet, an upper part of the water guiding channel is provided with a first water inlet; and the water guiding channel is provided with a water guiding chamber communicated with the first water inlet and the first drainage outlet, and the water guiding chamber communicates with an inside of the washing barrel via the first water inlet, the first water inlet is arranged on a radial side wall of the water guiding channel, and faces a rotating direction of the washing barrel during dehydrating, and an opening of the first water inlet faces the rotating direction of the washing barrel during dehydrating.

2. The washing machine according to claim 1, wherein a second water inlet is provided on an upper part of the drainage channel, and a water outlet is provided on a lower part of the drainage channel;

the drainage channel covers the first drainage outlet of the barrel wall of the washing barrel in a sealed manner, and the second water inlet communicates with the first drainage outlet.

3. The washing machine according to claim 1, wherein the drainage channel is an independent structure, and comprises a housing, a second water inlet and a water outlet;

the second water inlet is arranged on one end of the housing, and the water outlet is arranged on another end of the housing, the second water inlet communicates with the first drainage outlet, and the housing is internally provided with a drainage chamber between the second water inlet and the water outlet.

4. The washing machine according to claim 3, wherein the second water inlet is arranged on a side wall, adjacent to the outer wall of the washing barrel, of the housing, and connected with the first drainage outlet of the washing barrel in a sealed manner.

5. The washing machine according to claim 3, wherein the water outlet is arranged on a side wall of the housing opposite to the outer wall of the washing barrel, or, a water outlet direction of the water outlet is set downwards.

6. The washing machine according to claim 1, wherein a drainage chamber is formed by the drainage channel and the outer wall of the washing barrel, the drainage channel comprises a cover body which is arranged on the outer wall of the washing barrel and cooperates with the outer wall of the washing barrel to form the drainage chamber for discharging water downwards, the first drainage outlet is formed as the first water inlet of the drainage chamber, and a lower part of the drainage chamber is provided with a water outlet.

7. The washing machine according to claim 6, wherein the water outlet is formed on the cover body, or, a downward opening which is formed between the cover body and the outer wall of the washing barrel constitutes the water outlet.

8. The washing machine according to claim 1, wherein at least two first drainage outlets are provided, at least two drainage channels are provided, and each drainage channel corresponds to a respective first drainage outlet.

9. The washing machine according to claim 8, wherein the at least two first drainage outlets are arranged at intervals along a circumferential direction of the washing barrel, and the at least two drainage channels are arranged at intervals along the circumferential direction of the washing barrel.

10. The washing machine according to claim 1, further comprising a water collecting device which is arranged inside the box and configured to collect water discharged from the washing barrel, the water collecting device comprises a water collecting cavity and a second drainage outlet, a water outlet, which discharges water downwards, of the drainage channel, is arranged within the water collecting cavity.

11. The washing machine according to claim 10, wherein the water collecting cavity is internally provided with an annular groove concaved from a bottom wall of the water collecting cavity;

the annular groove extends downwards and a bottom of the annular groove is lower than the bottom wall of the water collecting cavity, and the water outlet of the drainage channel is arranged within the annular groove.

12. The washing machine according to claim 11, wherein a depth of the annular groove is set variably from high to low along a circumferential direction, and at least one second drainage outlet is arranged on a lowest part of the annular groove.

13. The washing machine according to claim 12, wherein the depth of the annular groove is increased along a direction which is same as a rotating direction of the washing barrel during dehydrating.

14. The washing machine according to claim 10, wherein an upper edge of a barrel wall constituting the water collecting cavity is higher than the water outlet;

the upper edge of the barrel wall of the water collecting cavity is not higher than the first drainage outlet.

15. The washing machine according to claim 1, wherein a part, higher than the first drainage outlet, of the barrel wall of the washing barrel is an impermeable structure, and an inside of the washing barrel communicates with an outside via the first drainage outlet on the lower part of the barrel wall.

16. The washing machine according to claim 1, wherein the water guiding channel, the first drainage outlet and the drainage channel are communicated in sequence to constitute a channel through which water is discharged towards an outside from the inside of the washing barrel during dehydrating.

17. The washing machine according to claim 1, wherein the water guiding channel is an independent structure, the water guiding chamber is arranged in the water guiding channel, or, the water guiding chamber is formed by the water guiding channel and the inner wall of the washing barrel.

18. The washing machine according to claim 1, wherein a balanced ring is provided above the washing barrel, a gap is formed between a radial side wall, facing a rotating direction of the washing barrel during dehydrating, of the water guiding channel and the balanced ring, the gap constitutes the second water inlet, and another radial side wall, opposite to the radial side wall, of the washing barrel during dehydrating extends to a lower surface of the balanced ring, and the another radial side wall is arranged in a sealed manner with the lower surface of the balanced ring.

* * * * *